US009340747B2

(12) United States Patent
Nakao et al.

(10) Patent No.: US 9,340,747 B2
(45) Date of Patent: May 17, 2016

(54) LUBRICATING OIL COMPOSITION FOR TRANSMISSIONS

(71) Applicant: JX Nippon Oil & Energy Corporation, Tokyo (JP)

(72) Inventors: Hajime Nakao, Tokyo (JP); Hitoshi Komatsubara, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 14/384,572

(22) PCT Filed: Nov. 9, 2012

(86) PCT No.: PCT/JP2012/079087

§ 371 (c)(1),
(2) Date: Sep. 11, 2014

(87) PCT Pub. No.: WO2013/136582

PCT Pub. Date: Sep. 19, 2013

(65) Prior Publication Data

US 2015/0057202 A1 Feb. 26, 2015

(30) Foreign Application Priority Data

Mar. 13, 2012 (JP) ..... 2012-055724

(51) Int. Cl.

| | |
|---|---|
| ***C10M 145/14*** | (2006.01) |
| ***C10M 169/04*** | (2006.01) |
| ***C10M 101/02*** | (2006.01) |
| *C10M 101/00* | (2006.01) |

(52) U.S. Cl.

CPC ..... *C10M 169/041* (2013.01); *C10M 101/02* (2013.01); *C10M 101/00* (2013.01); *C10M 145/14* (2013.01); *C10M 2203/003* (2013.01); *C10M 2203/1006* (2013.01); *C10M 2203/1025* (2013.01); *C10M 2209/084* (2013.01); *C10M 2215/064* (2013.01); *C10M 2215/08* (2013.01); *C10M 2215/28* (2013.01); *C10M 2219/106* (2013.01); *C10N 2220/022* (2013.01); *C10N 2220/023* (2013.01); *C10N 2230/02* (2013.01); *C10N 2230/06* (2013.01); *C10N 2230/08* (2013.01); *C10N 2230/54* (2013.01); *C10N 2240/04* (2013.01)

(58) Field of Classification Search

CPC ..... C10M 169/04; C10M 101/02; C10M 2203/1006; C10M 2209/084; C10M 101/00; C10M 145/14; C10M 2203/003; C10N 2220/022; C10N 2220/023; C10N 2230/06; C10N 2230/08; C10N 2230/54; C10N 2240/04
See application file for complete search history.

(56) References Cited

U.S. PATENT DOCUMENTS

| | | | | |
|---|---|---|---|---|
| 2009/0005273 | A1 | 1/2009 | Swartele et al. | |
| 2010/0016195 | A1 | 1/2010 | Shirahama et al. | |
| 2010/0041572 | A1 | 2/2010 | Sano et al. | |
| 2011/0049008 | A1 | 3/2011 | Tagawa et al. | |
| 2011/0053815 | A1 * | 3/2011 | Matsui ..... | C10M 169/04 508/384 |

FOREIGN PATENT DOCUMENTS

| | | | |
|---|---|---|---|
| CA | 2390229 | A1 | 5/2001 |
| EP | 2009084 | A1 | 12/2008 |
| EP | 2135929 | A1 | 12/2009 |
| EP | 2341122 | A1 | 7/2011 |
| JP | H11-286696 | A | 10/1999 |
| JP | 2003-514099 | A | 4/2003 |
| JP | 2004-262979 | A | 9/2004 |
| JP | 2010-037421 | A | 2/2010 |
| JP | 2010-090254 | A | 4/2010 |
| JP | 2010-531923 | A | 9/2010 |
| WO | 2007105769 | A1 | 9/2007 |
| WO | 2007114132 | A1 | 10/2007 |
| WO | 2009119505 | A1 | 10/2009 |
| WO | 2010142789 | A1 | 12/2010 |

OTHER PUBLICATIONS

Int'l Search Report issued Feb. 12, 2013 in Int'l Application No. PCT/JP2012/079087.

Extended Search Report issued Dec. 1, 2015 in EP Application No. 12871380.7.

* cited by examiner

*Primary Examiner* — Cephia D Toomer

(74) *Attorney, Agent, or Firm* — Panitch Schwarze Belisario & Nadel LLP

(57) ABSTRACT

The present invention provides a lubricating oil composition for transmissions which is improved in fuel saving properties and has excellent metal fatigue prevention properties and heat resistance. The lubricating oil composition comprises (A) a mineral base oil having a 100° C. kinematic viscosity of 1.5 $mm^2/s$ or higher and 3.5 $mm^2/s$ or lower, a pour point of −25° C. or lower, a viscosity index of 110 or greater, a % $C_N$ of 2 or greater and 20 or less and a % $C_A$ of 3 or less, the lubricating oil composition having a 100° C. kinematic viscosity of 2.5 $mm^2/s$ or higher and 3.8 $mm^2/s$ or lower.

12 Claims, No Drawings

LUBRICATING OIL COMPOSITION FOR TRANSMISSIONS

CROSS-REFERENCE TO RELATED APPLICATION

This application is a Section 371 of International Application No. PCT/JP2012/079087, filed Nov. 9, 2012, which was published in the Japanese language on Sep. 19, 2013, under International Publication No. WO 2013/136582 A1, and the disclosure of which is incorporated herein by reference.

TECHNICAL FIELD

The present invention relates to lubricating oil compositions, more specifically to a lubricating oil composition having excellent fuel saving properties due to its excellent viscosity temperature characteristics, anti-fatigue properties regardless of its low viscosity, and heat resistance, and in particular to a lubricating oil composition for transmissions suitable for automatic transmissions and/or continuously variable transmissions.

BACKGROUND ART

Conventionally, lubricating oils used for automatic transmissions, manual transmissions or internal combustion engines have been required to be enhanced in various durability-related properties such as thermal oxidation stability, anti-wear properties, anti-fatigue properties or the like and improved in low temperature viscosity characteristics such as improvement in viscosity temperature characteristics, reduction in low temperature viscosity and improvement in low temperature fluidity so as to improve the fuel saving properties. In order to improve these properties, a lubricating oil has been used, whose base oil is appropriately blended with various additives such as an anti-oxidant, a detergent dispersant, an antiwear agent, a friction modifier, a seal swelling agents, a viscosity index improver, an anti-foaming agents, a colorant and the like.

Recent transmissions and engines have been demanded to be fuel efficient, small and light and be increased in power output. Transmissions have been sought to be improved in power transmission capability in connection with the increased power output of the engines with which the transmissions are used in combination. Lubricating oils to be used for such transmissions have been, therefore, demanded to maintain high lubricity and to possess properties to prevent the wear or fatigue of surfaces of bearings and gears while reduced in the product viscosity and base oil viscosity as well as heat resistance. Generally, in order to improve the fuel saving properties of a lubricating oil, a technique is employed, wherein the viscosity temperature characteristics are improved by reducing the base oil viscosity and increasing the amount of a viscosity index improver. However, the reduction in the base oil viscosity degrades the anti-fatigue properties. Therefore, the development of a lubricating oil has been eagerly desired, which can achieve both good fuel saving properties and anti-wear properties or anti-fatigue properties at higher levels at the same time.

Under these circumstances, it has been known to use a base oil with good low temperature properties or a base oil with a high viscosity in combination, or to blend a phosphorus- or sulfur-based extreme pressure additive in a suitable amount in order to improve the fuel saving properties, low temperature viscosity characteristics and anti-fatigue properties at the same time (see, for example, patent documents 1 to 3 below).

However, the techniques disclosed in these patent documents are not sufficient to attain viscosity temperature characteristics, low temperature properties and anti-fatigue properties at the same time. It has been, therefore, demanded to develop a lubricating oil composition having all of these properties and characteristics but having no problem in other properties.

CITATION LIST

Patent Literature

Patent Literature 1: Japanese Patent Application Laid-Open Publication No. 2004-262979

Patent Literature 2: Japanese Patent Application Laid-Open Publication No. 11-286696

Patent Literature 3: Japanese Patent Application Laid-Open Publication No. 2003-514099

SUMMARY OF INVENTION

Technical Problem

In view of these current situations, the present invention has an object to provide a lubricating oil composition for transmissions that has excellent viscosity temperature characteristics as well as excellent anti-fatigue properties and heat resistance, particularly suitable for automatic transmissions and/or continuously variable transmissions.

Solution to Problem

As the result of the extensive researches and studies carried out by the inventors of the present invention, the present invention was accomplished on the basis of the finding that a lubricating oil composition comprising a specific base oil and specific additives were excellent in viscosity temperature characteristics and heat resistance and was able to be improved in metal fatigue life.

That is, the present invention is a lubricating oil composition for transmissions comprising (A) a mineral base oil having a 100° C. kinematic viscosity of 1.5 $mm^2/s$ or higher and 3.5 $mm^2/s$ or lower, a pour point of −25° C. or lower, a viscosity index of 110 or greater, a % $C_N$ of 2 or greater and 20 or less and a % $C_A$ of 3 or less, the lubricating oil composition having a 100° C. kinematic viscosity of 2.5 $mm^2/s$ or higher and 3.8 $mm^2/s$ or lower.

The present invention is the lubricating oil composition for transmissions according to the foregoing wherein (A) the mineral base oil has a naphthene content of 3 percent by mass or more and 15 percent by mass or less.

The present invention is the lubricating oil composition for transmissions according to the foregoing wherein it comprises a poly(meth)acrylate comprising at least a structural component derived from a monomer represented by formula (1) in an amount of 0.1 percent by mass or more and 20 percent by mass or less as Component (B).

(1)

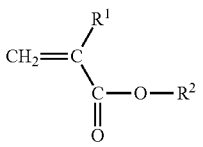

wherein $R^1$ is hydrogen or methyl, and $R^2$ is a hydrocarbon group having 1 to 30 carbon atoms.

The present invention is the lubricating oil composition for transmissions according to the foregoing wherein Component (B) comprises (B-1) a poly(meth)acrylate produced by polymerizing a monomer component comprising at least the following (Ba-1) to (Bd-1):

(Ba-1) a (meth)acrylate wherein $R^2$ is an alkyl group having 1 to 4 carbon atoms: 20 to 60 percent by mass;

(Bb-1) a (meth)acrylate wherein $R^2$ is an alkyl group having 5 to 10 carbon atoms: 0 to 30 percent by mass;

(Bc-1) a (meth)acrylate wherein $R^2$ is an alkyl group having 11 to 18 carbon atoms: 20 to 70 percent by mass; and (Bd-1) a (meth)acrylate wherein $R^2$ is an alkyl group having 19 to 40 carbon atoms: 5 to 50 percent by mass.

The present invention is the lubricating oil composition for transmissions according to the foregoing wherein Component (B) comprises (B-2) a poly(meth)acrylate produced by polymerizing a monomer component comprising at least the following (Ba-2) to (Bd-2):

(Ba-2) a (meth)acrylate wherein $R^2$ is an alkyl group having 1 to 4 carbon atoms: 0 to 60 percent by mass;

(Bb-2) a (meth)acrylate wherein $R^2$ is an alkyl group having 5 to 10 carbon atoms: 0 to 30 percent by mass;

(Bc-2) a (meth)acrylate wherein $R^2$ is an alkyl group having 11 to 18 carbon atoms: 30 to 100 percent by mass; and (Bd-2) a (meth)acrylate wherein $R^2$ is an alkyl group having 19 or more carbon atoms: 0 percent by mass.

The present invention is the lubricating oil composition for transmissions according to the foregoing wherein Component (Bc-2) is composed of the following (Bc-2-1) and (Bc-2-2):

(Bc-2-1) a (meth)acrylate wherein $R^2$ is an alkyl group having 11 to 15 carbon atoms: 60 to 100 percent by mass (on the (Bc-2) basis); and (Bc-2-2) a (meth)acrylate wherein $R^2$ is an alkyl group having 16 to 18 carbon atoms: 0 to 40 percent by mass (on the (Bc-2) basis).

The present invention is the lubricating oil composition for transmissions according to the foregoing wherein the composition ratio of Component (Ba-2) is from 0 to 10 percent by mass on the basis of the total mass of the monomer.

The present invention is the lubricating oil composition for transmissions according to the foregoing wherein (B-1) the poly(meth)acrylate has an weight average molecular weight of 10,000 to 60,000 and contained in an amount of 0.5 to 10 percent by mass, on the basis of the total mass of the composition and (B-2) the poly(meth)acrylate has an weight average molecular weight of 20,000 to 100,000 and contained in an amount of 0.05 to 10 percent by mass on the basis of the total mass of the composition.

The present invention is the lubricating oil composition for transmissions according to the foregoing wherein the composition contains no pour point depressants or viscosity index improver having an weight average molecular weight of 10,000 or greater other than Component (B).

Advantageous Effect of Invention

The lubricating oil composition of the present invention has excellent viscosity temperature characteristics and heat resistance and are superior in metal fatigue prevention properties and heat resistance.

The lubricating oil composition of the present invention is, therefore, suitable for automatic transmissions and/or continuously variable transmissions of automobiles, construction machines, agricultural machines and the like and also suitably used as a hydraulic oil for automobiles, construction machines, agricultural machines, working machine and the like.

DESCRIPTION OF EMBODIMENTS

The present invention will be described in detail.

The transmission lubricating oil composition of the present invention (hereinafter may also be referred to as "lubricating oil composition of the present invention") comprises Component (A) which is a mineral base oil having a 100° C. kinematic viscosity of 1.5 $mm^2/s$ or higher and 3.5 $mm^2/s$ or lower.

The 100° C. kinematic viscosity of Component (A) is preferably 2 $mm^2/s$ or higher, more preferably 2.5 $mm^2/s$ or higher, more preferably 2.7 $mm^2/s$ or higher and preferably 3.3 $mm^2/s$ or lower, more preferably 3.1 $mm^2/s$ or lower.

If the 100° C. kinematic viscosity of Component (A) exceeds 3.5 $mm^2/s$, the resulting composition would be degraded in viscosity temperature characteristics and low temperature viscosity characteristics. Whilst, the 100° C. kinematic viscosity is lower than 1.5 $mm^2/s$, the resulting composition would be poor in metal fatigue prevention properties and heat resistance due to insufficient oil film formation at lubricating sites and would be large in evaporative loss of the lubricating base oil.

The mineral base oil (A) used in the present invention has a viscosity index of 110 or greater, preferably 115 or greater, more preferably 120 or greater, most preferably 125 or greater and preferably 160 or less, more preferably 150 or less, more preferably 140 or less, particularly preferably 135 or less, most preferably 130 or less. If the viscosity index is lower than 110, the resulting composition could not obtain such viscosity temperature characteristics that it can exhibit fuel saving properties. If the viscosity index exceeds 160, the amount of n-paraffin in the lubricating base oil would increase and thus the resulting composition would be rapidly increased in viscosity at low temperatures and loose lubricity and functions of an operating oil.

Component (A) has a pour point of −25° C. or lower, preferably −27.5° C. or lower. No particular limitation is imposed on the lower limit. However, if it is too low, the viscosity index would be decreased and in view of economic efficiency in a dewaxing process, it is preferably −50° C. or lower, more preferably −45° C. or higher, more preferably −40° C. or higher, most preferably −37.5° C. or higher. A lubricating oil composition with excellent low temperature viscosity characteristics can be produced by adjusting the pour point of Component (A) to −25° C. or lower. If the pour point is lowered to below −50° C., the resulting composition would not obtain a sufficient viscosity index.

Although either solvent dewaxing or catalytic dewaxing may be used as the dewaxing process, catalytic dewaxing is preferable with the objective of further improving the low temperature viscosity characteristics.

No particular limitation is imposed on the % $C_P$ of Component (A), which is, however, preferably 70 or greater, and with the objective of further enhancing the thermal/oxidation stability and viscosity temperature characteristics, more preferably 80 or greater, more preferably 85 or greater, particularly preferably 90 or greater.

The % $C_A$ of Component (A) is preferably 3 or less, more preferably 2 or less, more preferably 1 or less. If the % $C_A$ exceeds 3, the resulting composition would be degraded in thermal/oxidation stability. The % $C_A$ may be 0 but is preferably 0.2 or greater, more preferably 0.5 or greater. This is because it is preferred for the solubilization of additives and elongation of metal fatigue life.

The % $C_N$ of Component (A) is preferably 20 or less, more preferably 15 or less, more preferably 10 or less and preferably 2 or greater, more preferably 3 or greater, more preferably 5 or greater, particularly preferably 7 or greater with the objective of further extending metal fatigue life.

No particular limitation is imposed on the saturate content of Component (A), which is, however, preferably 90 percent by mass or more, more preferably 94 percent by mass or more, more preferably 98 percent by mass or more, particularly preferably 99 percent by mass or more, most preferably 100 percent by mass with the objective of further enhancing the thermal/oxidation stability and viscosity temperature characteristics.

The ratio of the cyclic saturate content of the saturate content is from 3 to 15 percent by mass, preferably 5 percent by mass or more and preferably 10 percent by mass or less. The saturate content and ratio of cyclic saturate content thereof in a lubricating base oil satisfying the above-described conditions can provide a lubricating oil composition that can be enhanced in viscosity-temperature characteristics and thermal/oxidation stability and when the lubricating base oil is blended with additives, can retain the additives sufficiently stably dissolved in the lubricating base oil, allowing the additives to exhibit their functions in a higher level. Furthermore, with the saturate content and ratio of cyclic saturate content therein satisfying the above-described conditions, the lubricating base oil itself can be improved in friction characteristics and as the result improved in friction reducing effect and moreover in energy saving properties.

If the saturate content is less than 90 percent by mass, the resulting composition would be insufficient in viscosity-temperature characteristics, thermal/oxidation stability and friction characteristics. If the ratio of the cyclic saturate content of the saturate content is less than 3 percent by mass, the lubricating base oil would be insufficient in solubility of additives when blended, and thus the additives would fail to exhibit their functions effectively because an effective amount of the additives retained in dissolved state in the lubricating base oil would be decreased. If the ratio of the cyclic saturate content of the saturate content exceeds 15 percent by mass, additives when blended with the lubricating base oil would be degraded in its efficacy.

The saturate content referred in the present invention denotes the value (unit: percent by mass) measured in accordance with the method described in the aforesaid ASTM D 2007-93.

The ratios of the cyclic saturate content and noncyclic saturate content of the saturate content referred in the present invention denote the ratio of the cyclic saturate content (object to be measured: one to six ring naphthenes, unit: percent by mass) and the alkane content (unit: percent by mass) measured in accordance with ASTM D 2786-91.

No particular limitation is imposed on the aniline point of Component (A), which is, however, preferably 90° C. or higher, more preferably 95° C. or higher, more preferably 100° C. or higher, particularly preferably 103° C. or higher because a lubricating oil composition with excellent low temperature viscosity characteristics and fatigue life can be produced. No particular limitation is imposed on the upper limit of the aniline point, which may, therefore, exceed 130° C. as one embodiment but is preferably 130° C. or lower, more preferably 125° C. or lower, more preferably 120° C. or lower because Component (A) would be more excellent in solubility of additives or sludge and compatibility to sealing materials.

No particular limitation is imposed on the sulfur content of Component (A), which is, however, preferably 0.1 percent by mass or less, more preferably 0.05 percent by mass or less, more preferably 0.01 percent by mass or less. Most preferably, sulfur is not substantially contained.

No particular limitation is imposed on the nitrogen content of Component (A). However, nitrogen is contained in an amount of preferably 5 ppm by mass or less, more preferably 3 ppm by mass or less, desirously is not substantially contained with the objective of producing a composition with excellent thermal/oxidation stability.

The sulfur content and nitrogen content referred in the present invention denote the values measured in accordance with ASTM D4951.

No particular limitation is imposed on the average carbon number of Component (A), which is, however, preferably from 20 to 30, preferably from 22 to 28, more preferably from 23 to 27.

Component (A) may comprise one type of mineral oil only or a mixture of two or more types of mineral oils but is preferably one type of mineral oil so as to suppress the evaporativity of Component (A).

No particular limitation is imposed on the method of producing Component (A) as long as it has the above-described properties. However, specific examples of the lubricating base oil used in the present invention include those produced by subjecting a feedstock selected from the following base oils (1) to (8) and/or a lubricating oil fraction recovered therefrom to a given refining process and recovering the lubricating oil fraction:

(1) a distillate oil produced by atmospheric distillation of a paraffin-base crude oil and/or a mixed-base crude oil;

(2) a whole vacuum gas oil (WVGO) produced by vacuum distillation of the topped crude of a paraffin-base crude oil and/or a mixed-base crude oil;

(3) a wax produced by dewaxing of lubricating oil (slack wax) and/or a synthetic wax produced through a gas to liquid (GTL) process (Fischer-Tropsch wax, GTL wax);

(4) a mixed oil of one or more types selected from base oils (1) to (3) and/or an oil produced by mild-hydrocracking the mixed oil;

(5) a mixed oil of two or more types selected from base oils (1) to (4);

(6) a deasphalted oil produced by deasphalting base oil (1), (2) (3), (4) or (5);

(7) an oil produced by hydrocracking base oil (6); and (8) a mixed oil of two or more types selected from base oils (1) to (7).

The above-mentioned given refining process is preferably hydro-refining such as hydrocracking or hydrofinishing, solvent refining such as furfural extraction, dewaxing such as solvent dewaxing and catalytic dewaxing, clay refining with acidic clay or active clay or chemical (acid or alkali) refining such as sulfuric acid treatment and sodium hydroxide treatment. In the present invention, any one or more of these refining processes may be used in any combination and order.

The lubricating base oil used in the present invention is particularly preferably the following base oil (9) or (10) produced by subjecting a base oil selected from the above-described base oils (1) to (8) or a lubricating oil fraction recovered therefrom to a specific treatment:

(9) a hydrocracked mineral oil produced by hydrocracking a base oil selected from base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation; or

(10) a hydroisomerized mineral oil produced by hydroisomerizing a base oil selected from base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation.

When lubricating base oil (9) or (10) is produced, the dewaxing process includes preferably catalytic dewaxing with the objective of further enhancing the thermal/oxidation stability and low temperature viscosity characteristics and also anti-fatigue properties of the resulting lubricating oil composition.

If necessary, a solvent refining process and/or a hydrofinishing process may be carried out at appropriate timing upon production of lubricating base oil (9) or (10).

When catalytic dewaxing (catalyst dewaxing) is carried out, a hydrocracked/hydroisomerized oil is reacted with hydrogen in the presence of an appropriate dewaxing catalyst under effective conditions to decrease the pour point. In the catalytic dewaxing, part of a high boiling point substance in the cracked/isomerized product is converted to a low boiling point substance and the low boiling point substance is separated from a heavier base oil fraction to distillate base oil fractions thereby producing two or more types of lubricating base oils. Separation of the low boiling point substance may be carried out prior to produce the intended lubricating base oil or during distillation.

No particular limitation is imposed on the dewaxing catalyst if it can decrease the pour point of the hydrocracked/hydroisomerized oil. However, preferably the catalyst can produce the intended lubricating base oil from the hydrocracked/hydroisomerized oil at a high yield. Preferred examples of such a dewaxing catalyst include shape-selective molecular sieves, more specifically ferrierite, mordenite, ZSM-5, ZSM-11, ZSN-23, ZSM-35, ZSM-22 (also referred to as Theta-1 or TON), and silico-alumino-phosphates (SAPO). The molecular sieves are used in combination with preferably a catalytic metal component, more preferably a precious metal. Preferred combination include complexes of for example platinum and H-mordenite.

No particular limitation is imposed on the dewaxing conditions. However, preferably the temperature is from 200 to 500° C., and the hydrogen pressure is from 10 to 200 bar (1 MPa to 20 MPa). When a flow-through reactor is used, the $H_2$ treating rate is preferably from 0.1 to 10 kg/l/hr, and the LHSV is preferably from 0.1 to 10 $h^{-1}$, more preferably from 0.2 to 2.0 $h^{-1}$. The dewaxing is preferably carried out so that usually 40 percent by mass or less, preferably 30 percent by mass or less of a substance with an initial boiling point of 350 to 400° C., contained in the hydrocracked/hydroisomerized oil is converted to a substance with a boiling point lower than the initial boiling point.

The base oil of the lubricating oil composition of the present invention may be a mixture of Component (A) and various base oils.

Examples of such various base oils include mineral base oils and/or synthetic base oils.

Examples of the mineral base oils include mineral base oils other than Component (A). Specific examples of the synthetic base oils include polybutenes and hydrogenated compounds thereof; poly-α-olefins such as 1-octene oligomer, 1-decene oligomer and 1-dodecene oligomer or hydrogenated compounds thereof; diesters such as ditridecyl glutarate, di-2-ethylhexyl adipate, diisodecyl adipate, ditridecyl adipate and di-2-ethylhexyl sebacate; polyol esters such as neopentylglycol ester, trimethylolpropane caprylate, trimethylolpropane pelargonate, pentaerythritol 2-ethylhexanoate and pentaerythritol pelargonate; aromatic synthetic oils such as alkylnaphthalenes, alkylbenzenes, and aromatic esters; and mixtures of the foregoing.

The mineral base oil and/or synthetic base oil may be one type or a mixture of two or more types selected from the above-exemplified oils. For example, the base oil may be one or more type of the mineral base oils or synthetic base oils or a mixed oil of one or more type of the mineral base oils and one or more type of the synthetic base oils.

The content of the above-mentioned other base oils when mixed with Component (A) of the present invention is necessarily 30 percent by mass or less, preferably 20 percent by mass or less, more preferably 10 percent by mass or less, more preferably 7 percent by mass or less on the basis of the mixed base oil of Component (A) and the other base oil component.

The 100° C. kinematic viscosity and viscosity index of the mixed base oil of Component (A) and the other base oils are the same as those of Component (A) alone.

The transmission lubricating oil composition of the present invention comprises a base oil containing Component (A) and preferably (B) a poly(meth)acrylate.

Component (B) used in the present invention is preferably a poly(meth)acrylate pour point depressants and/or viscosity index improver having a structural unit represented by formula (1):

(1)

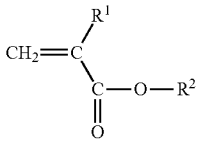

In formula (1), $R^1$ is hydrogen or methyl, preferably methyl, and $R^2$ is a hydrocarbon group having 1 to 30 carbon atoms.

Although Component (B) used in the present invention may contain a structural unit derived from a monomer represented by formula (2) or (3), it preferably contains no such a structural unit in view of elongation of metal fatigue life.

When Component (B) contains a structural unit derived from a monomer represented by formula (2) or (3), it can improve detergency and thus is preferably used when the lubricating oil composition for transmissions has a problem with the detergency.

(2)

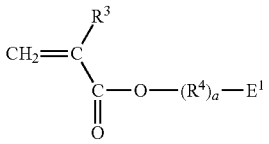

In formula (2), $R^3$ is hydrogen or methyl, $R^4$ is an alkylene group having 1 to 30 carbon atoms, $E^1$ is an amine residue or heterocyclic residue having 1 or 2 nitrogen atoms and 0 to 2 oxygen atoms, and a is an integer of 0 or 1.

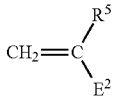

(3)

In formula (3), $R^5$ is hydrogen or methyl, and $E^2$ is an amine residue or heterocyclic residue having 1 or 2 nitrogen atoms and 0 to 2 oxygen atoms.

Specific examples of the groups represented by $E^1$ and $E^2$ include dimethylamino, diethylamino, dipropylamino, dibutylamino, anilino, toluidino, xylidino, acetylamino, benzoilamino, morpholino, pyrrolyl, pyrrolino, pyridyl, methylpyridyl, pyrrolidinyl, piperidinyl, quinonyl, pyrrolidonyl, pyrrolidono, imidazolino and pyrazino groups.

Specific preferable examples include dimethylaminomethylmethacrylate, diethylaminomethylmethacrylate, dimethylaminoethylmethacrylate, diethylaminoethylmethacrylate, 2-methyl-5-vinylpyridine, morpholinomethylmethacrylate, morpholinoethylmethacrylate, N-vinylpyrrolidone, and mixtures thereof.

No particular limitation is imposed on the method for producing the above-described poly(meth)acrylate. For example, it can be easily produced by radical-solution polymerization of a mixture of monomers in the presence of a polymerization initiator such as benzoyl peroxide.

Component (B) used in the present invention may contain a structural unit having a vinyl group such as styrene to adjust the flexibility of poly(meth)acrylate and solubility thereof in the base oil so as to increase the viscosity index.

Specifically, Component (B) used in the present invention is a copolymer produced by polymerizing a mixture of monomers (Ba) to (Bd) represented by formula (1) wherein $R^2$ varies:

(Ba) a (meth)acrylate wherein $R^2$ is an alkyl group having 1 to 4 carbon atoms;

(Bb) a (meth)acrylate wherein $R^2$ is an alkyl group having 5 to 10 carbon atoms;

(Bc) a (meth)acrylate wherein $R^2$ is an alkyl group having 11 to 18 carbon atoms; and (Bd) a (meth)acrylate wherein $R^2$ is an alkyl group having 19 or more carbon atoms.

Preferably, Component (B) contains (B-1) a poly(meth) acrylate produced by polymerizing a mixture of (Ba-1) to (Bd-1) monomers:

(Ba-1) a (meth)acrylate wherein $R^2$ is an alkyl group having 1 to 4 carbon atoms: 20 percent by mass or more, preferably 25 percent by mass or more, more preferably 30 percent by mass or more, more preferably 33 percent by mass or more and 60 percent by mass or less, preferably 50 percent by mass or less, more preferably 45 percent by mass or less, more preferably 40 percent by mass or less on the basis of the total mass of the monomers;

(Bb-1) a (meth)acrylate wherein $R^2$ is an alkyl group having 5 to 10 carbon atoms: 0 percent by mass or more and 30 percent by mass or less, preferably 20 percent by mass or less, more preferably 10 percent by mass or less on the basis of the total mass of the monomers;

(Bc-1) a (meth)acrylate wherein $R^2$ is an alkyl group having 11 to 18 carbon atoms: 20 percent by mass or more, more preferably 30 percent by mass or more, more preferably 35 percent by mass or more and 70 percent by mass or less, preferably 60 percent by mass or less, more preferably 50 percent by mass or less on the basis of the total mass of the monomers; and (Bd-1) a (meth)acrylate wherein $R^2$ is an alkyl group having 19 to 40 carbon atoms: 5 percent by mass or more, more preferably 10 percent by mass or more, more preferably 15 percent by mass or more, particularly preferably 20 percent by mass or more and 50 percent by mass or less, preferably 40 percent by mass or less, more preferably 30 percent by mass or less on the basis of the total mass of the monomers.

The carbon number of $R^2$ of Component (Bd-1) is preferably 20 or more and preferably 36 or fewer, more preferably 32 or fewer, more preferably 28 or fewer.

With this monomer composition, the polymethacrylate pour point depressant and/or viscosity index improver can be more effective in low temperature viscosity characteristics and fatigue life.

Preferably, Component (B) used in the present invention contains (B-2) a poly(meth)acrylate produced by polymerizing a mixture of monomers (Ba-2) to (Bd-2):

(Ba-2) a (meth)acrylate wherein $R^2$ is an alkyl group having 1 to 4 carbon atoms: 0 percent by mass or more and 60 percent by mass or less, preferably 40 percent by mass or less, more preferably 20 percent by mass or less, more preferably 10 percent by mass or less, most preferably 0 percent by mass on the basis of the total mass of the monomers;

(Bb-2) a (meth)acrylate wherein $R^2$ is an alkyl group having 5 to 10 carbon atoms: 0 percent by mass or more and 30 percent by mass or less, preferably 20 percent by mass or less, more preferably 10 percent by mass or less, most preferably 0 percent by mass on the basis of the total mass of the monomers;

(Bc-2) a (meth)acrylate wherein $R^2$ is an alkyl group having 11 to 18 carbon atoms: 30 percent by mass or more, preferably 50 percent by mass or more, more preferably 70 percent by mass or more, more preferably 80 percent by mass or more, particularly preferably 90 percent by mass or more and 100 percent by mass or less, preferably 95 percent by mass or less on the basis of the total mass of the monomers; and (Bd-2) a (meth)acrylate wherein $R^2$ is an alkyl group having 19 or more carbon atoms: 0 percent by mass.

With this monomer composition, the polymethacrylate pour point depressant and/or viscosity index improver can be more effective in low temperature viscosity characteristics and fatigue life.

Preferably, the above-described (B-1) poly(meth)acrylate and (B-2) poly(meth)acrylate are used in combination as Component (B).

Preferred examples of (B-2) the poly(meth)acrylate include poly(meth)acrylates (B-2a) produced by polymerizing a monomer composition of Components (Ba-2) and (Bb-2), each in an amount of 5 percent by mass or less, preferably 2 percent by mass or less, most preferably 0 percent by mass. With this monomer composition, low temperature viscosity characteristics are mostly improved. One example of these composition examples was used in Examples described below.

Preferred examples of (B-2) the poly(meth)acrylate include poly(meth)acrylates (B-2b) produced by polymerizing a monomer composition of 10 percent by mass or more and 40 percent by mass or less of Component (Ba-2), no Component (Bb-2) and preferably 50 percent by mass or more, more preferably 70 percent by mass or more and 90 percent by mass or less, more preferably 80 percent by mass or less of Component (Bc-2). With this monomer composition, the low temperature viscosity, viscosity index and fatigue life can be balanced. One example of these composition examples was used in Examples described below.

In the present invention, (Bc-1) in the monomer composition of (B-1) is preferably constituted by the following (Bc-1-1) and (Bc-1-2):

(Bc-1-1) a (meth)acrylate wherein $R^2$ is an alkyl group having 11 to 15 carbon atoms: 60 percent by mass or more, preferably 65 percent by mass or more, more preferably 70 percent by mass or more, more preferably 85 percent by mass or more and 100 percent by mass or less; and (Bc-1-2) a (meth)acrylate wherein $R^2$ is an alkyl group having 16 to 18 carbon atoms: 0 percent by mass or more and 40 percent by mass or less.

Similarly, (Bc-2) in the monomer composition of (B-2) is preferably constituted by the following (Bc-2-1) and (Bc-2-2):

(Bc-2-1) a (meth)acrylate wherein $R^2$ is an alkyl group having 11 to 15 carbon atoms: 60 percent by mass or more, preferably 65 percent by mass or more, more preferably 70 percent by mass or more, more preferably 85 percent by mass or more and 100 percent by mass or less; and (Bc-2-2) a (meth)acrylate wherein $R^2$ is an alkyl group having 16 to 18 carbon atoms: 0 percent by mass and more 40 percent by mass or less.

In Examples below, these are stated as (Bc-2a-1) and (Bc-2b-2) according to (B-2a) and (B-2b).

With this monomer composition, Component (B) can be effective in low temperature viscosity improvement while maintaining an effect of improving fatigue life.

The weight-average molecular weight of Component (B-1) is preferably 10,000 or greater, more preferably 15,000 or greater and preferably 60,000 or less, more preferably 50,000 or less, more preferably 30,000 or less. The weight-average molecular weight in this range is particularly effective in improving shear stability and fatigue life.

The weight-average molecular weight of Component (B-2) is preferably 20,000 or greater, more preferably 25,000 or greater and preferably 100,000 or less. The weight-average molecular weight in this range is particularly effective in improving fluidity at low temperatures and fatigue life.

In particular, the weight-average molecular weight of Component (B-2a) is 40,000 or greater, preferably 50,000 or greater and preferably 80,000 or less, more preferably 70,000 or less. The weight-average molecular weight in this range is effective in improving fatigue life and in particular fluidity at low temperatures.

In particular, the weight-average molecular weight of Component (B-2b) is preferably 20,000 or greater, more preferably 25,000 or greater and 60,000 or less, more preferably 40,000 or less. The weight-average molecular weight in this range is effective in improving particularly viscosity index, shear stability and fatigue life.

The weight-average molecular weight referred herein is the weight-average molecular weight based on polystyrene, as measured using a 150-CALC/GPC by Japan Waters Co., equipped with two GMHHR-M (7.8 mm ID×30 cm) columns by Tosoh Corp. in series, with tetrahydrofuran as the solvent, a temperature of 23° C., a flow rate of 1 mL/min, a sample concentration of 1% by mass, a sample injection rate of 75 μL and a differential refractometer ($R^1$) as the detector.

The content of Component (B) of the lubricating oil composition of the present invention is 0.1 percent by mass or more, preferably 0.2 percent by mass or more, more preferably 0.3 percent by mass or more and preferably 20 percent by mass or less, more preferably 15 percent by mass or less, more preferably 10 percent by mass or less, most preferably 6 percent by mass or less on the basis of the total mass of the composition.

If the content of Component (B) is less than 0.1 percent by mass, it would be less effective in enhancing the viscosity index and reducing the product viscosity and thus the resulting composition may not be enhanced in the fuel saving properties. If the content of Component (B) is more than 20 percent by mass, it calls for a decrease in base oil viscosity, possibly resulting in degraded lubricating performance under sever lubrication conditions (high temperature high shear condition), causing defects such as wear, seizure, fatigue breaking.

The content of Component (B-1) of the lubricating oil composition of the present invention is 0.05 percent by mass or more, preferably 0.1 percent by mass or more, more preferably 0.5 percent by mass or more and preferably 10 percent by mass or less, more preferably 8 percent by mass or less, more preferably 6 percent by mass or less, most preferably 4 percent by mass or less.

If the content of Component (B-1) is less than 0.05 percent by mass, it would be less effective in enhancing viscosity index and reducing the product viscosity and thus the resulting composition may not be enhanced in the fuel saving properties. If the content is more than 10 percent by mass, it calls for a decrease in base oil viscosity, possibly resulting in degraded lubricating performance under sever lubrication conditions (high temperature high shear condition), causing defects such as wear, seizure, fatigue breaking.

The content of Component (B-2) of the lubricating oil composition in the present invention is 0.05 percent by mass or more, preferably 0.1 percent by mass or more, more preferably 0.5 percent by mass or more and preferably 10 percent by mass or less, more preferably 8 percent by mass or less, more preferably 6 percent by mass or less, most preferably 4 percent by mass or less on the basis of the total mass of the composition.

When Component (B-2) is (B-2a), the content thereof is 0.05 percent by mass or more, preferably 0.1 percent by mass or more, more preferably 0.2 percent by mass or more and preferably 3 percent by mass or less, more preferably 2 percent by mass or less, more preferably 1 percent by mass or less, most preferably 0.5 percent by mass or less on the basis of the total mass of the composition.

If the content of (B-2a) is less than 0.05 percent by mass, it would be less effective in enhancing viscosity index and reducing the product viscosity and thus the resulting composition may not be enhanced in the fuel saving properties. If the content is more than 3 percent by mass, it would cause the increase in viscosity to be large and would be disadvantageous for the low temperature viscosity improvement.

When Component (B-2) is (B-2b), the content thereof is 0.5 percent by mass or more, preferably 1 percent by mass or more, more preferably 1.5 percent by mass or more and preferably 10 percent by mass or less, more preferably 8 percent by mass or less, more preferably 6 percent by mass or less, most preferably 0.4 percent by mass or less, on the basis of the total mass of the composition.

If the content of (B-2b) is less than 0.5 percent by mass, it would be less effective in enhancing viscosity index and reducing the product viscosity and thus the resulting composition may not be enhanced in the fuel saving properties. If the content is more than 10 percent by mass, it calls for a decrease in base oil viscosity, possibly resulting in degraded lubricating performance under sever lubrication conditions (high temperature high shear condition), causing defects such as wear, seizure, fatigue breaking.

No particular limitation is imposed on the combination of (B-1) and, (B-2a) and (B-2b) in the above-described (B) polymethacrylate component if it corresponds to the above-described viscosity characteristics of the composition. However, the combination is preferably constituted in accordance with the above-described amount of each component. Whereby, the low temperature viscosity characteristics, shear stability, viscosity index and fatigue life are improved with good balance.

In addition to Component (B), the lubricating oil composition of the present invention may further comprise an ordinary conventional non-dispersant or dispersant type poly (meth)acrylates, a non-dispersant or dispersant type ethylene-α-olefin copolymers and hydrogenated compounds thereof, polyisobutylene and hydrogenated compounds thereof, styrene-diene hydrogenated copolymers, styrene-maleic anhydride ester copolymers, and polyalkylstyrenes.

The lubricating oil composition of the present invention preferably contains no pour point depressants or viscosity index improver having a weight-average molecular weight of 10,000 or greater, other than Component (B). Whereby, no viscosity reduction caused by shear occurs and the lowest 100° C. kinematic viscosity can be achieved, resulting in the maximum fuel saving effect.

The lubricating oil composition of the present invention may contain various additives if its excellent viscosity temperature characteristics and low temperature properties, anti-fatigue properties and heat resistance are not hindered. No particular limitation is imposed on the additives, which may, therefore, be any additives that have been used in the field of lubricating oil. Specific examples of the lubricating oil additive include metallic detergents, ashless dispersants, anti-oxidants, extreme pressure additives, antiwear agents, friction modifiers, pour point depressants, corrosion inhibitors, rust inhibitors, demulsifiers, metal deactivators, anti-foaming agents. These additives may be used alone or in combination.

Examples of the metallic detergent include sulfonate detergents, salicylate detergents and phenate detergents. Normal salts, basic salts or overbased salts of alkali metals or alkaline earth metals may be blended. When the metallic detergent is used, any one or more of these detergents may be blended.

The ashless dispersant may be any ashless dispersant that is usually used for a lubricating oil. Examples of the ashless dispersant include mono- or bis-succinimides having in their molecules at least one straight-chain or branched alkyl or alkenyl group having 40 to 400 carbon atoms, benzylamines having in their molecules at least one alkyl or alkenyl group having 40 to 400 carbon atoms, polyamines having in their molecules at least one alkyl or alkenyl group having 40 to 400 carbon atoms, and boron-, carboxylic acid-, and phosphoric acid-modified products thereof. Any one or more of these ashless dispersants may be blended.

The anti-oxidant may be an ashless anti-oxidant such as a phenol- or amine-based anti-oxidant, or a metallic anti-oxidant such as a copper- or molybdenum-based anti-oxidant.

Examples of the friction modifier include ashless friction modifiers such as fatty acid ester-, aliphatic amine- and fatty acid amide-base friction modifiers and metallic friction modifier such as molybdenum dithiocarbamate and molybdenum dithiophosphate.

The extreme pressure additive or antiwear agent may be any extreme pressure additive or anti-oxidant that has been used for lubricating oil. For example, sulfuric-, phosphoric- and sulfuric-phosphoric extreme pressure additives may be used. Specific examples include phosphorus acid esters, thiophosphorus acid esters, dithiophosphorus acid esters, trithiophosphorus acid esters, phosphoric acid esters, thiophosphoric acid esters, dithiophosphoric acid esters, trithiophosphoric acid esters, amine salts, metal salts or derivatives thereof, dithiocarbamates, zinc dithiocaramates, molybdenum dithiocarbamates, disulfides, polysulfides, and sulfurized fats and oils.

Examples of the corrosion inhibitor include benzotriazole-, tolyltriazole-, thiadiazole-, and imidazole-types compounds.

Examples of the rust inhibitor include petroleum sulfonates, alkylbenzene sulfonates, dinonylnaphthalene sulfonates, alkenyl succinic acid esters, and polyhydric alcohol esters.

Examples of the demulsifier include polyalkylene glycol-based non-ionic surfactants such as polyoxyethylenealkyl ethers, polyoxyethylenealkylphenyl ethers, and polyoxyethylenealkylnaphthyl ethers.

Examples of the metal deactivator include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of the anti-foaming agent include silicone oil with a 25° C. kinematic viscosity of 1,000 to 100,000 $mm^2/s$, alkenylsuccinic acid derivatives, esters of polyhydroxy aliphatic alcohols and long-chain fatty acids, aromatic amine salts of methylsalicylate and o-hydroxybenzyl alcohol.

When these additives are contained in the lubricating oil composition of the present invention, they are contained in an amount of 0.1 to 20 percent by mass on the total composition mass basis.

No particular limitation is imposed on the 100° C. kinematic viscosity of the lubricating oil composition of the present invention, which is, however, preferably 3.8 $mm^2/s$ or lower, more preferably 3.7 $mm^2/s$ or lower, more preferably 3.6 $mm^2/s$ or lower, most preferably 3.5 $mm^2/s$ or lower and preferably 2.5 $mm^2/s$ or higher, more preferably 2.6 $mm^2/s$ or higher, more preferably 2.7 $mm^2/s$ or higher, particularly preferably 3 $mm^2/s$ or higher. If the 100° C. kinematic viscosity is lower than 2.5 $mm^2/s$, the resulting composition may have problems with oil film retainability at lubricating sites and evaporativity. If the 100° C. kinematic viscosity exceeds 3.8 $mm^2/s$, the resulting composition could lack fuel saving properties.

No particular limitation is imposed on the viscosity index of the lubricating oil composition of the present invention, which is, however, preferably 120 or greater, more preferably 140 or greater, more preferably 160 or greater in view of fuel saving properties.

The −40° C. Brookfield (BF) viscosity of the lubricating oil composition of the present invention is preferably 15,000 mPa·s or lower, more preferably 10,000 mPa·s or lower, more preferably 8,000 mPa·s or lower, more preferably 5,000 mPa·s or lower, particularly preferably 3,000 mPa·s or lower, most preferably 2,500 mPa·s or lower.

The Brookfield viscosity referred herein denotes the value measured in accordance with ASTM D2983.

The lubricating oil composition of the present invention is a lubricating oil composition having excellent anti-wear properties and anti-fatigue properties as well as excellent low temperature fluidity and particularly suitable as an automatic transmission oil and/or a continuously variable transmission oil.

The lubricating oil composition of the present invention is excellent in properties of a transmission oil other than the properties mentioned above and thus suitably used as a lubricating oil for automatic transmissions, manual transmissions, differential gears of automobiles, construction machinery, agricultural machines and the like. Furthermore, the lubricating oil composition may be suitably used as a lubricating oil required to have anti-wear properties, anti-fatigue properties, and low temperature viscosity characteristics, such as a gear oil for industrial use, a lubricating oil for the gasoline engines, diesel engines, and gas engines of automobiles such as two- and four-wheeled vehicles, power generators, and ships, a turbine oil, and a compressor oil.

EXAMPLES

Hereinafter, the present invention will be described in more detail by way of the following examples and comparative examples, which should not be construed as limiting the scope of the invention.

Examples 1 to 6 and Comparative Examples 1 and 2

As set forth in Table 1 below, lubricating oil compositions according to the present invention (Examples 1 to 6) and those for comparison (Comparative Examples 1 and 2) were prepared. The kinematic viscosities, low temperature viscosity characteristics, anti-fatigue properties, load bearing properties by four-ball test and oxidation stability of each of the resulting compositions were evaluated, and the results are also set forth in Table 1.

The details of the base oils in Table 1 are as follows.

[Base Oil]

[1] Base Oil A-1: mineral oil [100° C. kinematic viscosity: 2.84 $mm^2/s$, 40° C. kinematic viscosity: 10.4 $mm^2/s$, viscosity index: 125, aniline point: 114° C., % $C_P$: 92, % $C_A$: 0, % $C_N$: 7.8, pour point: −30.0° C., S content: 1 ppm by mass or less, N content: 3 ppm by mass or less, naphthene content: 5 percent by mass]

[2] Base Oil A-2: mineral oil [100° C. kinematic viscosity: 2.74 $mm^2/s$, 40° C. kinematic viscosity: 10.2 $mm^2/s$, viscosity index: 109, aniline point: 104° C., % $C_P$: 75, % $C_A$: 1, % $C_N$: 23.5, pour point: −27.5° C., S content: 1 ppm by mass or less, N content: 3 ppm by mass or less, naphthene content: 5 percent by mass]

[3] Base Oil A-3: mineral oil [100° C. kinematic viscosity: 2.08 $mm^2/s$, 40° C. kinematic viscosity: 6.87 $mm^2/s$, viscosity index: 96, aniline point: 89° C., % $C_P$: 63, % $C_A$: 6, % $C_N$: 32.4, pour point: −25.0° C., S content: 800 ppm by mass, N content: 20 ppm by mass]

[Component (B)]

[1] (B-1): polymethacrylate with a monomer composition of the following (Ba-1) to (Bd-1), having a weight-average molecular weight of 20,000:

(Ba-1) $R^2$ is an alkyl group having 1 carbon atom:content ratio 34 percent by mass;

(Bb-1) $R^2$ is an alkyl group having 5 to 10 carbon atoms: content ratio 0 percent by mass;

(Bc-1-1) $R^2$ is an alkyl group having 11 to 15 carbon atoms:content ratio 6 percent by mass (Bc-1-2) $R^2$ is an alkyl group having 16 to 18 carbon atoms:content ratio 34 percent by mass (Bd-1) $R^2$ is an alkyl group having 19 or more carbon atoms:content ratio 24 percent by mass

[2] (B-2a): polymethacrylate with a monomer composition of the following (Ba-2a) to (Bd-2a), having a weight-average molecular weight of 61,000:

(Ba-2a) $R^2$ is an alkyl group having 1 carbon atom:content ratio 2 percent by mass;

(Bb-2a) $R^2$ is an alkyl group having 5 to 10 carbon atoms: content ratio 0 percent by mass;

(Bc-2a-1) $R^2$ is an alkyl group having 11 to 15 carbon atoms:content ratio 90 percent by mass (Bc-2a-2) $R^2$ is an alkyl group having 16 to 18 carbon atoms:content ratio 8 percent by mass (Bd-2a) $R^2$ is an alkyl group having 19 or more carbon atoms:content ratio 0 percent by mass

[3] (B-2b): polymethacrylate with a monomer composition of the following (Ba-2b) to (Bd-2b), having a weight-average molecular weight of 30,000:

(Ba-2b) $R^2$ is an alkyl group having 1 carbon atom:content ratio 24 percent by mass;

(Bb-2b) $R^2$ is an alkyl group having 5 to 10 carbon atoms: content ratio 0 percent by mass;

(Bc-2b-1) $R^2$ is an alkyl group having 11 to 15 carbon atoms:content ratio 76 percent by mass;

(Bc-2b-2) $R^2$ is an alkyl group having 16 to 18 carbon atoms:content ratio 0 percent by mass; and (Bd-2b) $R^2$ is an alkyl group having 19 or more carbon atoms:content ratio 0 percent by mass.

[Other Additives: C-1]

succinimide containing 1.5 percent by mass of nitrogen, 1.5 percent by mass of boron, alkenyl molecular weight 2,000:3 percent by mass, thiadiazole containing 7 percent by mass of nitrogen: 0.2 percent by mass amine-based anti-oxidant containing 4 percent by mass of nitrogen: 0.5 percent by mass metallic detergent containing 10 percent by mass of calcium: 0.1 percent by mass succinimide-based friction modifier containing 6 percent by mass of nitrogen: 1.0 percent by mass ester-based friction modifier: 0.5 percent by mass ester-based seal swelling agents: 0.3 percent by mass (1) Low Temperature Viscosity Characteristics The −40° C. BF viscosity of each of the compositions was measured in accordance with ASTM D2983. In this test, the lower BF viscosity the composition has, it is more excellent in low temperature fluidity.

(2) Anti-Fatigue Properties

The fatigue life up to pitting was evaluated for each composition under the following conditions using a high temperature rolling-contact fatigue test machine. The ratio of the fatigue life up to pitting of each composition was calculated on the basis of the result of Comparative Example 1. In this test, a longer fatigue life ratio (L50 ratio and L10 ratio) indicates that the composition is more excellent in anti-fatigue properties.

Thrust needle bearing (surface pressure: 1.9 GPa, rotating speed: 1410 rpm, oil temperature: 120° C.)

(3) High-Speed Four-Ball Heat Resistance

The last non-seizure load (LNSL) of each of the compositions at a rotating speed of 1800 rpm was measured using a high-speed four-ball tester in accordance with ASTM D 2596. In this test, a larger last non-seizure load indicates that the composition is more excellent in heat resistance.

(4) Oxidation Stability

The acid number increase and content of matters insoluble in pentane of each of the compositions were measured in accordance with JIS K 2514 4 (Oxidation stability test for internal combustion engine oil).

As apparent from the results set forth in Table 1, it is confirmed that the lubricating oil compositions of Examples 1 to 6 according to the present invention were excellent in viscosity temperature characteristics, low temperature characteristics, anti-fatigue properties and heat resistance.

Whereas, the composition of Comparative Example 1 containing no Component (A) as the base oil was poor in viscosity temperature characteristics, low temperature viscosity characteristics and anti-fatigue properties. Likely, the composition of Comparative Example 2 containing no Component (A) was also poor in anti-fatigue properties and heat resistance and insufficient in low temperature viscosity characteristics.

| | | | Example 1 | Example 2 | Example 3 | Example 4 | Example 5 | Example 6 | Comparative Example 1 | Comparative Example 2 |
|---|---|---|---|---|---|---|---|---|---|---|
| A-1 | | mass % | 100 | 100 | 100 | 100 | 100 | 100 | | |
| A-2 | | mass % | | | | | | | 100 | |
| A-3 | | mass % | | | | | | | | 100 |
| Base oil viscosity | | $mm^2/s$ | 2.8 | 2.8 | 2.8 | 2.8 | 2.8 | 2.8 | 2.7 | 2.1 |
| B-1 | | in mass % | | 3 | | | 3 | 3 | | |
| B-2a | | in mass % | | | 0.3 | | 0.3 | | | |
| b-2b | | in mass % | | | | 2 | | 2 | | |
| C-1 | | in mass % | 12.0 | 12.0 | 12.0 | 12.0 | 12.0 | 12.0 | 12.0 | 12.0 |
| Kinematic | 40° C. | $mm^2/s$ | 12.0 | 12.9 | 12.2 | 12.8 | 13.1 | 13.8 | 12.59 | 9.31 |
| viscosity | 100° C. | $mm^2/s$ | 3.25 | 3.51 | 3.30 | 3.48 | 3.58 | 3.76 | 3.243 | 2.6 |
| Viscosity index | | | 145 | 162 | 148 | 159 | 167 | 176 | 128 | 113 |
| BF viscosity | −40° C. | mPa · s | 5000 | 2200 | 2100 | 2400 | 1900 | 2100 | 21000 | 1000000 or more |
| Fatigue life | L10 | min | 1.2 | 1.3 | 1.2 | 1.2 | 1.4 | 1.4 | 1 | 0.7 |
| (Unisteel) | L50 | min | 1.5 | 1.7 | 1.3 | 1.3 | 1.8 | 1.7 | 1 | 0.8 |
| Four-ball test | LWI | N | 284 | 299 | 273 | 291 | 284 | 282 | 273 | 240 |
| 1800 rpm | WL | N | 1961 | 1961 | 1961 | 1961 | 1961 | 1961 | 1961 | 1961 |
| | LNSL | N | 618 | 618 | 618 | 618 | 618 | 618 | 618 | 490 |
| Oxidation stability (ISOT: 165° C., 144 h) | | | | | | | | | | |
| Viscosity ratio (100° C.) | | | 1.08 | 1.21 | 1.13 | 1.25 | 1.19 | 1.23 | 1.18 | 1.2 |
| Oxidation increase | | mg · KOH/g | 1.1 | 1.2 | 1.2 | 1.2 | 1.2 | 1.2 | 1.2 | 1.3 |
| Pentane insoluble (B method) | | mass % | 0 | 0 | 0 | 0 | 0 | 0 | 0 | 0 |

The invention claimed is:

1. A lubricating oil composition for transmissions comprising:

(A) a mineral base oil having a 100° C. kinematic viscosity of 1.5 $mm^2/s$ or higher and 3.5 $mm^2/s$ or lower, a pour point of −25° C. or lower, a viscosity index of 110 or greater, a % CN of 2 or greater and 20 or less and a % CA of 3 or less, (B) a poly(meth)acrylate comprising at least a structural component derived from a monomer represented by formula (1) in an amount of 0.1 percent by mass or more and 20 percent by mass or less, the lubricating oil composition having a 100° C. kinematic viscosity of 2.5 $mm^2/s$ or higher and 3.8 $mm^2/s$ or lower:

(1)

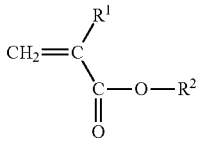

wherein $R^1$ is hydrogen or methyl, and $R^2$ is a hydrocarbon group having 1 to 30 carbon atoms, wherein Component (B) comprises (B-1) a poly(meth) acrylate produced by polymerizing a monomer component comprising (Ba-1) to (Bd-1):

20 to 60 percent by mass of (Ba-1) a (meth)acrylate wherein $R^2$ is an alkyl group having 1 to 4 carbon atoms;

0 to 30 percent by mass of (Bb-1) a (meth)acrylate wherein $R^2$ is an alkyl group having 5 to 10 carbon atoms;

20 to 70 percent by mass of (Bc-1) a (meth)acrylate wherein $R^2$ is an alkyl group having 11 to 18 carbon atoms; and 5 to 50 percent by mass of (Bd-1) a (meth)acrylate wherein $R^2$ is an alkyl group having 19 to 30 carbon atoms.

2. A lubricating oil composition for transmissions comprising:

(A) a mineral base oil having a 100° C. kinematic viscosity of 1.5 $mm^2/s$ or higher and 3.5 $mm^2/s$ or lower, a pour point of −25° C. or lower, a viscosity index of 110 or greater, a % $C_N$ of 2 or greater and 20 or less and a % $C_A$ of 3 or less, (B) a poly(meth)acrylate comprising at least a structural component derived from a monomer represented by formula (1) in an amount of 0.1 percent by mass or more and 20 percent by mass or less, the lubricating oil composition having a 100° C. kinematic viscosity of 2.5 $mm^2/s$ or higher and 3.8 $mm^2/s$ or lower:

(1)

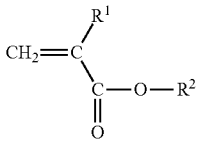

wherein $R^1$ is hydrogen or methyl, and $R^2$ is a hydrocarbon group having 1 to 30 carbon atoms, wherein Component (B) comprises (B-2) a poly(meth)acrylate produced by polymerizing a monomer component comprising (Ba-2) to (Bd-2):

0 to 60 percent by mass of (Ba-2) a (meth)acrylate wherein $R^2$ is an alkyl group having 1 to 4 carbon atoms;

0 to 30 percent by mass of (Bb-2) a (meth)acrylate wherein $R^2$ is an alkyl group having 5 to 10 carbon atoms;

30 to 100 percent by mass of (Bc-2) a (meth)acrylate wherein $R^2$ is an alkyl group having 11 to 18 carbon atoms; and 0 percent by mass of (Bd-2) a (meth)acrylate wherein $R^2$ is an alkyl group having 19 to 30 carbon atoms.

3. The lubricating oil composition for transmissions according to claim 1, wherein the mineral base oil (A) has a naphthene content of 3 percent by mass or more and 15 percent by mass or less.

4. The lubricating oil composition for transmissions according to claim 2, wherein the mineral base oil (A) has a naphthene content of 3 percent by mass or more and 15 percent by mass or less.

5. The lubricating oil composition for transmissions according to claim 2, wherein Component (Bc-2) contains (Bc-2-1) and (Bc-2-2):

60 to 100 percent by mass (on the (Bc-2) basis) of (Bc-2-1) a (meth)acrylate wherein $R^2$ is an alkyl group having 11 to 15 carbon atoms; and 0 to 40 percent by mass (on the (Bc-2) basis) of (Bc-2-2) a (meth)acrylate wherein $R^2$ is an alkyl group having 16 to 18 carbon atoms.

6. The lubricating oil composition for transmissions according to claim 4, wherein Component (Bc-2) contains (Bc-2-1) and (Bc-2-2):

60 to 100 percent by mass (on the (Bc-2) basis) of (Bc-2-1) a (meth)acrylate wherein $R^2$ is an alkyl group having 11 to 15 carbon atoms; and 0 to 40 percent by mass (on the (Bc-2) basis) of (Bc-2-2) a (meth)acrylate wherein $R^2$ is an alkyl group having 16 to 18 carbon atoms.

7. The lubricating oil composition for transmissions according to claim 2, wherein the composition ratio of Component (Ba-2) is from 0 to 10 percent by mass on the basis of the total mass of the monomer.

8. The lubricating oil composition for transmissions according to claim 5, wherein the composition ratio of Component (Ba-2) is from 0 to 10 percent by mass on the basis of the total mass of the monomer.

9. The lubricating oil composition for transmissions according to claim 1, wherein (B-1) the poly(meth)acrylate has an weight average molecular weight of 10,000 to 60,000 and is contained in an amount of 0.5 to 10 percent by mass, on the basis of the total mass of the composition.

10. The lubricating oil composition for transmissions according to claim 2, wherein (B-2) the poly(meth)acrylate has an weight average molecular weight of 20,000 to 100,000 and contained in an amount of 0.05 to 10 percent by mass on the basis of the total mass of the composition.

11. The lubricating oil composition for transmissions according to claim 1, wherein the composition contains no pour point depressants or viscosity index improver having an weight average molecular weight of 10,000 or greater other than Component (B).

12. The lubricating oil composition for transmissions according to claim 2, wherein the composition contains no pour point depressants or viscosity index improver having an weight average molecular weight of 10,000 or greater other than Component (B).

* * * * *